US006481427B1

(12) United States Patent
Javaherian

(10) Patent No.: US 6,481,427 B1
(45) Date of Patent: Nov. 19, 2002

(54) SOFT LINEAR $O_2$ SENSOR

(75) Inventor: Hossein Javaherian, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 58 days.

(21) Appl. No.: 09/687,104

(22) Filed: Oct. 16, 2000

(51) Int. Cl.[7] ..... F02D 41/34; F02D 41/26
(52) U.S. Cl. ..... 123/673
(58) Field of Search ..... 123/696, 694, 123/693, 672, 673

(56) References Cited

U.S. PATENT DOCUMENTS 4,917,067 A * 4/1990 Yoshida ..... 123/694
5,033,438 A * 7/1991 Feldinger et al. ..... 123/694
6,325,056 B1 * 12/2001 Weining et al. ..... 123/443

* cited by examiner

*Primary Examiner*—Gene Mancene
*Assistant Examiner*—Arnold Castro
(74) *Attorney, Agent, or Firm*—Kathryn A. Marra

(57) ABSTRACT

The switching characteristic of zirconia solid electrolyte type oxygen sensors is shaped to generate a limited proportional range around the stoichiometric A/F through a modified operation of the port injection or direct fuel injection control system. The linear response is obtained by imposing fuel-injection offsets, of particular patterns and magnitudes, on the average fuel quantity determined by the closed-loop fuel controller. The linear range of the sensor is then used for precise stoichiometric A/F control for tailpipe emission improvements. Also, further reductions in HC and CO emissions during cold-start (with leaner air-fuel ratio operation) and reduction in NOx (slightly rich air-fuel ratio operation) under warm-up and hot conditions are made possible using production $O_2$ sensors.

12 Claims, 3 Drawing Sheets

SOFT LINEAR $O_2$ SENSOR

TECHNICAL FIELD

This invention pertains to closed loop microprocessor control of air-to-fuel mass ratio (A/F) in a fuel-injected automotive internal combustion engine using feedback signals from the vehicle's exhaust oxygen ($O_2$) sensor. More specifically, this invention pertains to a process for modifying the operation of the vehicle fuel control system to change the on-off, nonlinear response of the exhaust $O_2$ sensor to a more useful proportional response around the stoichiometric A/F. The present invention is driven by the need to operate the engine slightly rich or slightly lean for their respective emissions advantages during hot or cold engine operation.

BACKGROUND OF THE INVENTION

Most current production exhaust oxygen sensors (EOS) are zirconia-based, solid electrolyte, electrochemical devices that are used in conjunction with three-way catalytic converters to precisely control exhaust air-fuel ratio and to reduce vehicle tailpipe emissions. These robust sensors have been used for many years with powertrain control modules (PCM) for closed-loop computer control of fuel injector(s) in supplying gasoline to the cylinders of the engine in amounts near the stoichiometric A/F. The stoichiometric A/F is approximately 14.7 for most common gasoline fuels available in the market today. The PCM is programmed for engine operation near the stoichiometric A/F for best performance of the catalytic converter.

Such oxygen sensors are heated by exhaust gas or an additional power supply and produce a relatively low voltage (0.0 V to approximately 0.5 V) at A/F higher than stoichiometric value and a high voltage (0.5 V to 1.0 V) at lower A/F ratios. Around the stoichiometric A/F, the response of these sensors is unreliable and indeterminate in the manner in which they have been used. Therefore, the sensor steady state characteristic response to the exhaust mixture variations is unusable when the combustion mixture of air and fuel changes from slightly rich of stoichiometric A/F to slightly lean, or vice versa. In other words, in this region the magnitude of the voltage signal from the zirconia electrolyte oxygen sensor cannot presently be used by the PCM as indicative of the precise A/F. Instead, the $O_2$ sensor is treated by the PCM as an on-off device, or simply as a fuel lean or fuel rich indicator (with respect to stoichiometric A/F). The PCM is programmed to respond, at a fixed rate, by changing the duration of the next fuel injection event to compensate for the present fuel lean or rich indicating signal.

Depending upon engine speed and the number of engine cylinders, the PCM must command a fuel injection amount into the intake port of a cylinder, or into a cylinder, many times per second. By considering the current and recent past $O_2$ sensor voltage values to adjust the duration of the next fuel injection event, the PCM delivers an almost average stoichiometric A/F to the engine. However, because of the on/off nature of the sensor signal, the engine is essentially just cycling around stoichiometric A/F. Such an "averaged" A/F closed-loop control achieves significant reductions in emissions of unburned hydrocarbons, carbon monoxide and nitrogen oxides as compared to a pre-programmed PCM using the open-loop control and without actual feedback from downstream exhaust information. However, further reductions in tailpipe emissions are required in the recent government-mandated emission standards. Therefore, more precise A/F management and fuel control is now essential.

Accordingly, it is an object of this invention to provide a process for changing the switch-like output of the venerable zirconia-type oxygen sensor to a proportional response around the stoichiometric A/F. This newly created linear range in the output of the production $O_2$ sensors would allow the current PCM, or fuel controller, to manage engine operation closer to the desired air-to-fuel ratio (slightly lean or rich of stoichiometric) and achieve further emission reductions with essentially the current production hardware.

SUMMARY OF THE INVENTION

The oxygen content in the combustion products of a hydrocarbon-fuel engine depends significantly on the proportions of air and fuel supplied to the cylinders. When the A/F is above the stoichiometric value, there is significant excess oxygen for combustion and, consequently, an appreciable oxygen content in the exhaust. The zirconia-based oxygen sensor operates with ambient air at one electrode and the oxygen containing exhaust at the counter electrode. Under such A/F conditions, the voltage response of a zirconia-based oxygen sensor is fairly constant in the range of about 0.0 V to about 0.5 V. When the engine is momentarily operated at A/F below the stoichiometric value, the excess oxygen is immediately utilized in combustion of hydrocarbon fuel and much less oxygen remains in the exhaust. The voltage output of the sensor is typically increased to the range of about 0.5 V to 1.0 V at all A/F above the stoichiometric value.

The voltage response of the sensor changes abruptly from one such range to the other when the engine A/F changes from slightly above the stoichiometric value to slightly below, or vice versa. This change in voltage is subject to process variability, and the sensor output in the range 0.3 V to 0.6 V cannot be reliably used by a PCM for fuel control. This range corresponds to the approximate critical A/F range of the stoichiometric value ±1.0 A/F (i.e., 13.7 to 15.7 for gasoline fuel).

In accordance with this invention, it has been found that by continually introducing a suitable pattern of individual fuel injector biases of known size, at any given engine speed, high frequency A/F oscillations of desired amplitude are produced at the oxygen sensor location. The PCM controls the on time of some or all of the injectors to deliver amounts of fuel that deviate from the average amount prescribed by the current PCM determined fueling strategy. Such deviations are imposed in each engine fueling cycle in which it is desired to operate the engine in accordance with this invention. The imposition of these individual cylinder A/F imbalances, through fuel injector biasing, changes the on-off nonlinear characteristic of the $O_2$ sensor in the affected A/F range. The result is a modification of the steady state characteristic of the sensor so that a dependable proportional response of the $O_2$ sensor over an A/F range of, e.g., 14.7±0.5 is created.

For example, in a 4-cylinder engine, with the cylinder firing sequence 1-3-4-2, running at a steady 1500 rpm, fuel injection events occur at 20 millisecond (ms) intervals or with a frequency of 50 Hz. On selected fuel injectors (2 or 4 injectors), the fuel pulse widths are altered to cause a slight perturbation of A/F. During such steady engine operation (e.g., at 60 kPa), a normal fuel injection period per cylinder of about 6.0 ms may provide near stoichiometric A/F. Instead, injection duty cycles of 6.6 ms, 6.0 ms, 5.4 ms and 6.0 ms in cylinders 1, 3, 4, and 2, respectively, are repeatedly introduced in the cylinder intake ports or directly into the cylinders.

These and like fuel imbalances, preferably introduced during each fueling cycle of engine operation, produce a fluctuation in exhaust oxygen content and, thus, in voltage output at each event. The imbalances, when introduced, will typically amount to about one to fifteen percent of the amount of fuel that the PCM determines to be injected in the next cylinder fueling event to maintain the desired A/F. Averaged values of these outputs provide a usable linear voltage response to changes in A/F. The magnitude of the imbalance in injection time, here, e.g., ±0.6 ms, produces a proportional range in the downstream oxygen sensor response characteristic around the stoichiometric A/F. Such alteration of the nature of the oxygen sensor characteristics over the selected A/F range is suitably utilized to achieve the desired A/F as follows.

In a family of substantially identical production engines, such as four-cylinder intake port fuel-injected engines, the PCM is programmed to time the fuel injector duty cycles over a full range of operating conditions of the engine. In accordance with this invention, a calibration curve is obtained for correlation between the average sensor voltage and the average exhaust pipe A/F measured in a test environment on a representative engine. This calibration curve characteristic depends on the magnitude of fuel injector biasing and the pattern imposed as well as other operating conditions such as airflow rate and engine speed. Suitable nominal values for fuel injection duration are selected for test operation of a representative engine for adaptation of the subject process. A pattern and level of individual fuel injector biasing is initially selected. An oxygen sensor reference voltage, for example, $V_s$ =0.5 V, is selected and fuel injection is controlled, with the selected cylinder fuel flow and biasing pattern, to operate the engine at pre-converter sensor location $V_s$ values around the chosen level. One can suitably start at 0.5 V and proceed higher or lower in small increments and slowly enough to allow steady state operation at each $V_s$ level established. While the test engine is being operated at selected average $V_s$ levels, air to fuel ratios based on tailpipe exhaust analyses, downstream of the catalytic converter, are being carefully measured.

The tailpipe analysis may be performed with a suitable wide-range A/F exhaust sensor or, preferably, with an emission gas analyzer for more precision. This exhaust data is used to correlate the average of measured A/F with the corresponding average voltage responses of the pre-converter production $O_2$ sensor exposed to the exhaust stream from the perturbed fuel injector operation. This practice is suitably repeated over a range of $O_2$ sensor set points, for example, from 0.1 to 0.9 volt.

Such responses of the $O_2$ sensor are essentially proportional to the average exhaust A/F over a small region around the stoichiometric A/F. The sensor proportional range created in this way is equal to the magnitude of A/F biasing imposed in the cylinders. For example, an injector biasing of ±0.5 A/F between cylinders would lead to an extended proportional range of ±0.5 A/F in the sensor characteristic around the stoichiometric A/F value. This proportional range may, however, be affected by significant mixing in the exhaust pipe before reaching the $O_2$ sensor location. For this reason, the sensor is installed at a location very close to the exhaust port where cylinders merge.

The data produced is then stored in the PCM memory in the form of an $O_2$ sensor characteristic lookup table for future engine control. The PCM can now command fuel injections to the respective cylinders using a suitable pattern and level of injector biasing to produce a limited linear exhaust oxygen sensor (LEOS) response from an otherwise highly nonlinear device. In the case of each cylinder fueling event, the bias is from the amount of fuel, or injector on-time, determined for that cylinder in view of current vehicle speed and power requirements. And the PCM can refer to this lookup table to control the overall injection cycles so that the appropriate $O_2$ sensor response is maintained and, as a result, the desired A/F is achieved.

This process can be adapted for use during cold starts to reduce emissions of unburned hydrocarbons and carbon monoxide, or it can be used for slightly fuel rich for warmed-up or hot engine operation to markedly reduce NOx emissions.

Other objects and advantages of the invention will become more apparent from a description of a preferred embodiment which follows. Reference will be made to the drawing figures which are described in the following section.

DESCRIPTION OF THE PREFERRED EMBODIMENT

Figure 1:
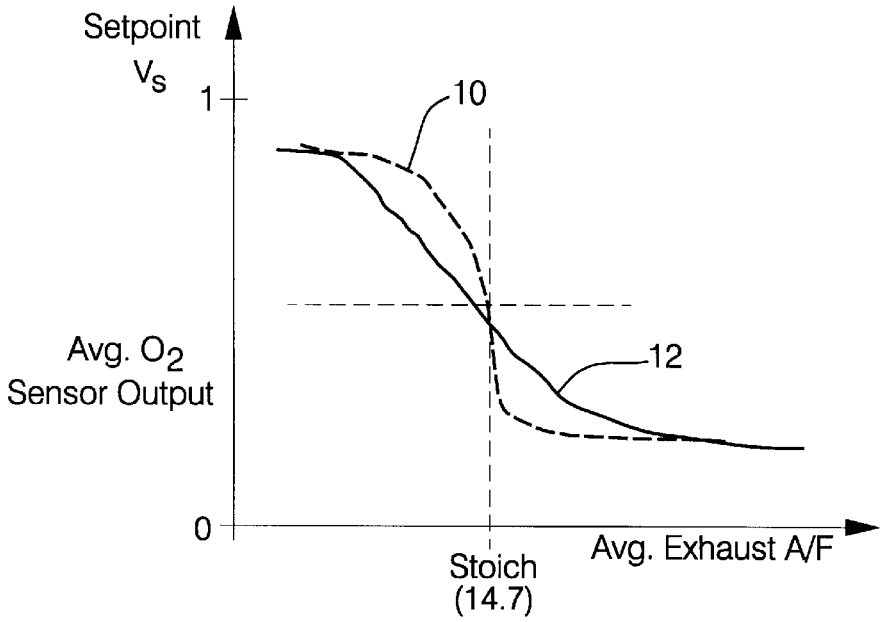
FIG. 1 a graph of average oxygen sensor output in volts vs. average exhaust A/F for a zirconia electrolyte oxygen sensor. A nonlinear response around the stoichiometric A/F exhaust from the sensor is obtained during the conventional mode of fuel injector control, but a linear response is obtained when A/F imbalances are imposed in accordance with this invention.

Zirconia-based, solid electrolyte type oxygen sensors have been used in millions of automobiles for many years in combination with the noble metal containing three-way catalytic converter. It has been recognized that the converter best reduces the exhaust gas content of each of carbon monoxide, unburned hydrocarbons and nitrogen oxides when the A/F of the engine (especially a gasoline-fueled engine) is maintained close to the stoichiometric proportions of fuel and air. Typically a sensor is located in the exhaust manifold just upstream of the converter can. A second sensor is sometimes located in the exhaust tail pipe just downstream of the converter. The second sensor is often used for fuel control as well as catalytic converter monitoring.

After being heated to an operating temperature, the sensor produces voltage signals based on current exhaust oxygen content in the region of its sensing electrode. Changes in the proportions of air and fuel (A/F) introduced into the cylinders of the engine produce changes in the composition of the exhaust, especially the oxygen content. The sensor typically responds to changes in exhaust oxygen content within a few ms of a change. The fueling of the engine cylinders is usually managed so that such changes are not abrupt and the effect of time-delay between an adjustment in A/F and the corresponding change in exhaust composition is compensated properly.

Voltage signals from the sensor are available to the powertrain control module (PCM) which controls fuel injector timing and duty cycle and many other engine and transmission operations. Such feedback is used by the PCM in closed loop management of fuel injection. In the current mode of engine fuel management, the sensor provides a response like that shown in curve 10 of FIG. 1.

Curve 10 shows the average response in fractions of a volt for steady state average exhaust gas compositions corresponding to air to fuel mass ratios (A/F) centered on the stoichiometric A/F of 14.7 for the regular gasoline fuel. It is seen that the slope of curve 10 near stoichiometric A/F is very steep. This range cannot be used in the conventional way by a PCM to control fuel injection times to a specific voltage output of the oxygen sensor. Instead, the sensor signal is used like an on-off switch with respect to stoichiometric A/F. The PCM averages (or filters) the current and recent several voltage signals of the sensor every 12.5 ms, for example, and calculates the fuel injection time for the next cylinder, or sequence of cylinders, necessary to return the sensor signal stepwise toward stoichiometric A/F. This process is repeated for each injection event, or sequence of fueling events, with the PCM reacting in stepwise increments to changes in the $O_2$ sensor output. Thus, the exhaust gas composition and corresponding oxygen sensor signals oscillate in the stoichiometric region as fuel injection rates are varied only in response to a signal that suggests that A/F is departing from the stoichiometric A/F target. However, fuel economy could be improved and NOx emissions, for example, could be reduced if the $O_2$ sensor could be made to produce a linear response around a desired A/F for more precise control of fuel injection.

It has been found that by introducing a particular pattern of individual fuel injector biases of known size, high-frequency A/F oscillations of desired amplitude are produced at the $O_2$ sensor location. The imposition of individual cylinder A/F imbalances cause the binary (on-off) character of the $O_2$ sensor to change to a useful moderately sloped linear response as seen in curve 12 in FIG. 1. Instead of injecting an amount of fuel determined appropriate to steadily correct the trend of the exhaust signal away from stoichiometric A/F, arbitrary small increases and decreases to such determined fuel charge into individual cylinders are regularly and repeatedly employed. Such a regular pattern of biases in the amount of fuel injected over succeeding fueling events produces rapid changes in the sensor signal that when averaged produce a desired linear response within the A/F range of the imbalances. In this new method of managing fuel injector timing, the average oxygen sensor output is proportional to the average engine A/F measured at the sensor location. The proportionality range is a function of the size of injector biases introduced.

Curve 12 in FIG. 1 shows the combined effect of individual fuel injector offsets on the apparent conversion of the switch to a linear sensor. The size of the proportional range is only a function of the size of the individual A/F imbalances generated by the injector offsets. However, due to strong mixing in the exhaust pipe, the actual engine out A/F shape is not completely preserved at the sensor location. And, therefore, as the engine speed and load varies, the linear range is stretched or shrunk modestly. However, always the limited range is inclusive of the stoichiometry and, by proper design, is of sufficient size to allow direct measurement of the actual A/F at the entrance to the three-way catalyst.

In the conventional port injection fuel control system, the switching characteristic of $O_2$ sensors would lead to sustained limit-cycle oscillations in fuel and A/F signal. The frequency of oscillations is mainly determined by the transportation time-delay between fuel injection and A/F sensor. This frequency is usually 0.1 to 2.5 Hz during Federal Test Procedure (emission test) cycles depending on engine speed and controller parameters. The existing low-frequency signal cannot generate a linear band of any substance around stoichiometry. Indeed, in current practice, the $O_2$ sensor response between 0.3 and 0.6 volts, due to its unpredictability, is deemed useless and therefore discarded.

This concept of introducing a pattern of fuel injector duty-time biases of known magnitudes is a simple technique to generate a proportional band in $O_2$ sensor response at around stoichiometric A/F. The resulting imbalances in the amount of injected fuel impose high-frequency A/F variations into the exhaust stream impinging on the $O_2$ sensor element. The frequency of variations depends on the imbalance pattern selected and the engine speed. For example, in a four-cylinder engine at 1500 rpm, two pure harmonics frequencies (12.5 Hz and 25 Hz) are possible as shown by patterns 2(*a*) and 2(*b*) of FIG. 2. In a V6 engine, the maximum frequency at 1500 rpm is increased to 37.5 Hz corresponding to bank-to-bank fuel injector offsets.

Figure 2A:
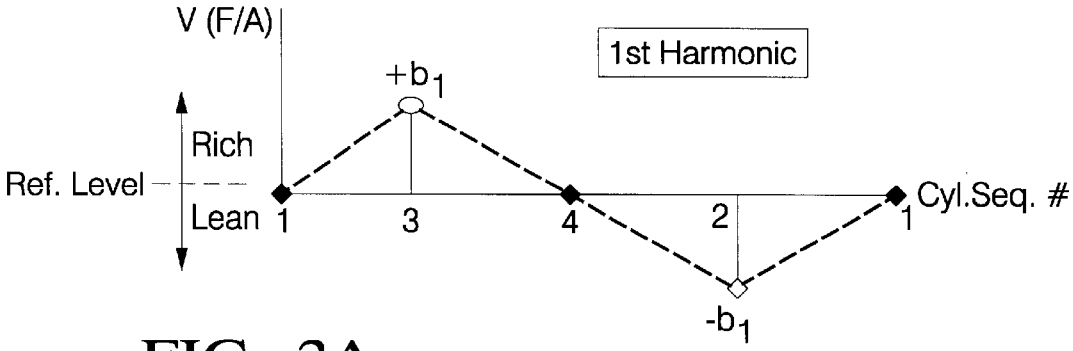
FIG. 2 comprises two graphs illustrating two suitable patterns of A/F imbalances introduced by fuel injector biasing in a four-cylinder engine. Pattern 2(*a*) is a first harmonic pattern of fuel rich and fuel lean imbalances that is completed after one full cycle (four injection events, two crankshaft revolutions) of engine cylinder fueling. Pattern 2(*b*) is a second harmonic pattern of fuel rich and fuel lean imbalances that is completed after two injection events (one rankshaft revolution).
Figure 2B:
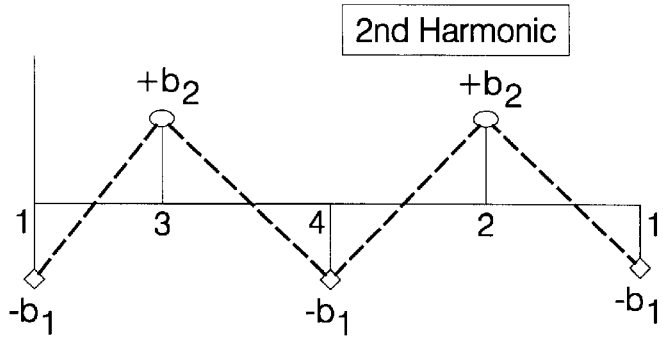

FIG. 2 shows suitable patterns of fuel injector biasing for a four-cylinder engine as an example of a practice of this invention. These are fuel injector duty time patterns for a port injected or direct injection gasoline fueled engine. Pattern 2(*a*) is a simple sequence of fuel imbalances as the PCM is determining the injector charge times for the conventional fueling sequence of cylinders 1-3-4-2, respectively. In this illustration, the PCM has determined from previous $O_2$ sensor signals a suitable average quantity of fuel to be injected at the next cylinder fueling event. This amount is represented by the horizontal reference level baseline on patterns 2(*a*) and 2(*b*). The actual fuel amount represented by the baseline may vary from cylinder to cylinder if engine speed or load is changing. Fuel imbalances are shown as vertical departures from the reference line. They represent percentage injection biases, e.g., 1–15%, from the PCM determined amount of fuel for the fueling event.

In pattern 2(*a*) cylinder one receives the reference amount of fuel which is charged by a PCM signal that specifies that the fuel injector for cylinder 1 be kept open a specified time, e.g., 6 milliseconds. Cylinder 3 receives a richer fuel charge (an imbalance or bias), designated $+b_1$in which the injector duty time is, e.g., 6.6 ms. Cylinder 4 receives the reference charge, but cylinder 2 receives a lean charge, $-b_1$, of 5.4 ms. The fuel imbalances indicated in pattern 2*a* as $+b_1$ and $-b_1$ are variables determined by the designer of the process or determined by the PCM and typically range from 1–15% of the PCM determined amount of fuel for the current target A/F. Pattern 2*a* is repeated every two revolutions of the engine or at 12.5 Hz in this example where the engine is operating at 1500 rpm. This is the simplest pattern and is the first harmonic of this fuel imbalancing cycle. This pattern is applicable to four or eight cylinder engines.

Pattern 2(*b*) is a second harmonic of 2(*a*), and it repeats in half the number of fueling events. As seen in pattern 2(*b*), each cylinder receives either a lean charge, $-b_2$, or a rich charge, $+b_2$. It is seen that the 2(*b*) pattern is repeated after each two cylinder fueling events or at 25 Hz in this example. The values of $+b_2$ and $-b_2$ may vary with engine speed and the required range of the sensor output to be made linear by the practice of this invention. Again, they are unbalancing or bias factors in the range of 1–15% that the PCM applies to its first determination of fuel to be injected at the current fueling event. This pattern of fuel imbalances could be used with any engine having an even number of cylinders.

In the practice of this invention, either the first harmonic or the second harmonic, or an additive combination of the two, can be used, with appropriate valuation of $b_1$ and/or $b_2$, to produce any necessary or desired pattern of fuel biases for the practice of this invention. The additive combination could, for example, be one part of the first harmonic and two parts of the second harmonic. By looking at patterns 2(*a*) and 2(*b*), it is readily seen that if they are simply added, the pattern for four cylinders becomes $-b_2$, $b_1+b_2$, $-b_2$, $b_2-b_1$. The values of $b_1$ and $b_2$ may be the same or different.

In closed-loop port fuel operation of the fuel control system with the imposed fueling imbalances, due to the generated linear range, limit cycle oscillations are locked out. While the sensor response shows oscillatory A/F variations, both frequency (speed dependent) and magnitude of oscillations are at the designer's discretion.

Figure 3:
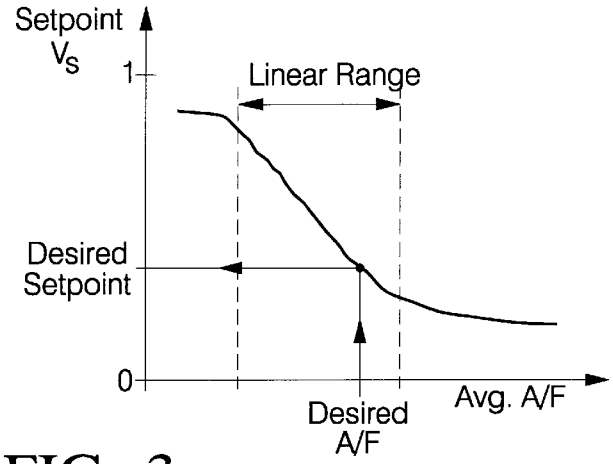
FIG. 3 is an illustrative steady state graph of linear oxygen sensor response characteristic versus a range of potential desired A/F values illustrating direct closed loop A/F control in accordance with an embodiment of this invention.

The practice of regularly and continually introducing imbalances in the amount of fuel injected into the cylinders of an engine thus can be utilized to produce a linear response over a desired A/F region of $O_2$ sensor output. An example of such a response and use for it is illustrated in FIG. 3. The average response of the zirconia electrolyte type sensor is shown in volts. The moderate linear slope from the relatively high response, e.g., 0.8V, at low A/F to the relatively low response at high A/F is apparent. Accordingly, it becomes possible to control a succession of fueling events, including a suitable pattern of fueling imbalances, to both induce the linear response and control A/F at the desired set point within the linear range depicted in FIG. 3. Moreover, with such a linear sensor output it is possible to control fuel injection to operate for prolonged times in a slightly fuel lean mode for enhanced fuel economy or in a slightly rich mode for low NOx emissions.

However, in order to use this practice to control fuel injection for engine operation at a desired A/F, the engine-sensor combination must be calibrated for such beneficial operation. The steady-state characteristic (i.e., calibration) of a linear $O_2$ sensor (LEOS) under closed-loop proportional-plus-integral (PI) control is determined for an engine family-sensor combination, for example, through the following steps:

1. Select nominal values for the PI fuel injection controller parameters that have worked well in the production engine and sensor system, and other variables such as typical fuel injector duty times in milliseconds for a specific change in sensor A/F near stoichiometric A/F.

2. Select the pattern and level of biasing (e.g., $b_1$ or $b_2$ in FIG. 2) and apply the biasing to the selected individual injectors.

3. Select the set-point VS for the PI closed-loop controller. One can start from 0.5 volt $O_2$ sensor output (i.e., close to stoichiometric A/F) and proceed upward or downward in small increments and slow enough to assure that steady state is established.

4. Measure the average A/F signals (i.e., tailpipe A/F after catalyst) using a WRAF sensor or an emission gas analyzer.

5. Measure the average pre-converter $O_2$ sensor response $V_{pre}$ (or the post converter $O_2$ voltage $V_{post}$) and correlate with the respective exhaust data determined in step 4 above.

6. Repeat steps 3–5 above for the range of $O_2$ sensor set-points 0.1–0.9 V.

7. Map the sensor output signals by plotting $V_s$ (alternatively $V_{pre}$ or $V_{post}$) vs. the measured A/F. The proportional range will be evident on the modified characteristic curves. A typical curve is shown in FIG. 3.

8. If the linearity range for the application in hand is not sufficient, then go to step 2 above and repeat with increased $b_1$ or $b_2$ values. In contrast, if the linear range is too large, reduce $b_1$ or $b_2$ values.

Figure 4:
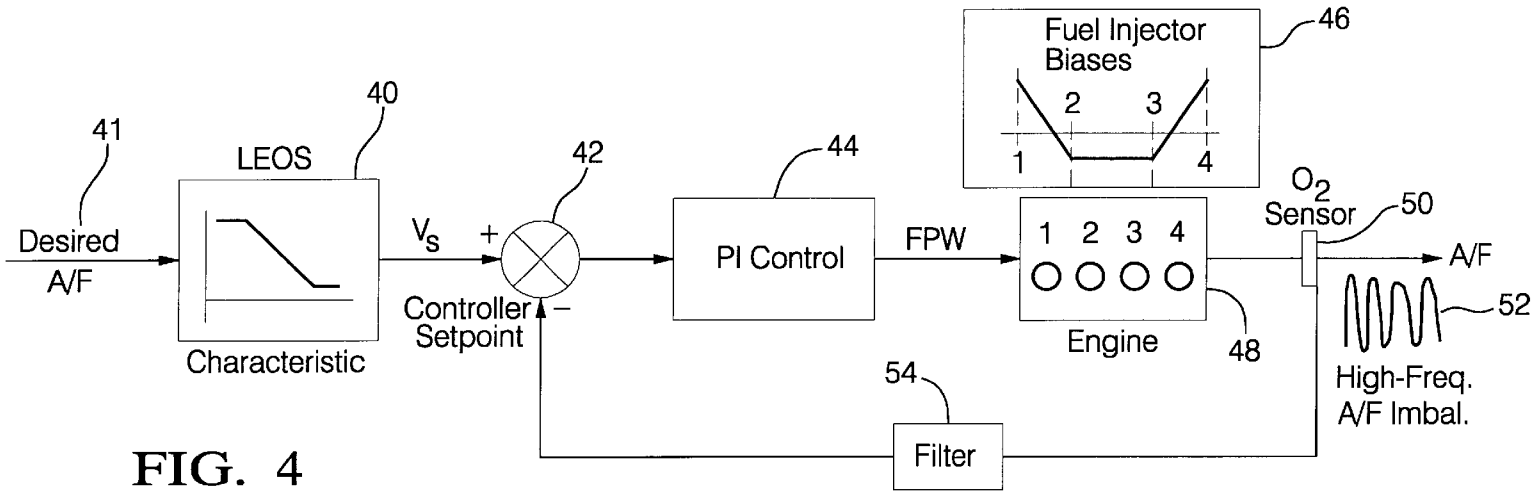
FIG. 4 is a schematic diagram illustrating the practice of an embodiment of this invention.

FIG. 4 is a schematic flow diagram illustrating the use of the above acquired linear exhaust oxygen sensor (LEOS) data.

Referring to FIG. 4, the PCM considers the operating conditions of the engine and transmission and determines a desired A/F at step 41. The PCM then chooses an appropriate $O_2$ sensor set-point value ($V_s$) from maps or calibration curves (prepared as described above) stored in memory of the module in the form of table lookup 40. The value $V_s$ is stored in memory as a control set-point 42 and serves as a current mode reference for the PCM as it exercises its port fuel injection control 44. The PCM selects a fuel injector bias pattern 46. The bias pattern illustrated in block 46 will be recognized as the second harmonic pattern 2(*a*) for a four cylinder engine as applied to the cylinders 1–4 depicted in engine cylinder block 48. The PCM controls the fuel injector pulse width, indicated at FPW in FIG. 4, as the cylinders are fueled in 1-3-4-2 order.

Combustion occurs in the respective cylinders within a few milliseconds. The exhaust gases from the cylinders sequentially enter the exhaust manifold and within another few milliseconds impinge upon the oxygen sensor before entering the catalytic converter. The pre-converter electrochemical $O_2$ sensor reacts to the mixing gases and signals its response each few milliseconds. Since the cylinders are receiving slightly varying amounts of fuel, rich and lean of the set point A/F, the exhaust gas composition reflects the rapidly varying A/F inputs. Indeed, in the bias pattern illustrated at 46, the input A/F varies between each fueling event. The output signals of the sensor likewise vary rapidly and widely as indicated at 52. However, they are fed back to the PCM where they are continually averaged (or filtered by standard methods such as notch filtering) at 54 over a suitable few current and immediate past signals, and such average values are correlated well with the LEOS linear pattern depicted at 40.

The PCM compares the current averaged sensor response with the current set point and makes adjustments in its determination of the new "average" fuel charge. Of course, this fuel imbalance practice is imposed by the PCM along with its determination of the engine speed and load requirements of the vehicle.

In the above description of a practice of the invention, the signals from an $O_2$ sensor close to the exhaust manifold and upstream of the catalytic converter were used. This assures a fast response to changes in engine operation and may be used to adjust overly fuel rich operation at cold start even before the system may be sufficiently warmed up for full closed-loop fuel control. The invention can also be practiced using an $O_2$ sensor located downstream of the catalytic converter. A post-converter sensor provides data on thoroughly mixed exhaust gases and permits precise control of A/F especially when it is desired to operate continually in a slightly fuel rich or lean regime.

The graphs of FIG. 5 illustrate the effect of continuous fuel imbalances on the output signals of both a conventional solid electrolyte $O_2$ sensor and a wide-range air fuel (WRAF) exhaust sensor. The graphs report data from a few seconds of operation of a four-cylinder engine on a dynamometer. The engine was operated at 60 kPa and 1500 rpm. The fuel system was put under PCM port injection control and the fuel injectors were biased to produce 5–10% A/F imbalances with either pattern of imbalances depicted in FIG. 2 (either first or second harmonic). The exhaust pipe contained an empty catalytic converter can of 85 $in^3$ for the purpose of generating thorough mixing of the exhaust stream from individual cylinders. There was no active catalyst in the exhaust pipe.

Two sets of pairs of $O_2$-WRAF sensors were employed in the test. The first set was installed immediately after the exhaust manifold. In this set the $O_2$ sensor was used as the control sensor and the WRAF sensor was used to monitor the actual A/F at that location. The second set was installed after the empty converter can to simulate the averaged values of $O_2$ and WRAF sensors after thorough mixing of the exhaust gas in the exhaust pipe.

Throughout the tests, a conventional port injection control process was used for fuel control except that the fuel injectors were biased as in pattern 2(*a*) with $b_1=\pm 10\%$ of fuel injector duty cycle. At stoichiometry and an average fuel injection of 6.0 ms into cylinders, this would provide fuel pulse widths 6.6 ms in cylinder 1, 6.0 ms in cylinder 3, 5.4 ms in cylinder 4 and 6.0 ms in cylinder 2 corresponding to a pattern of imbalances of (0.6, 0, −0.6, 0) ms for the firing sequence (1, 3, 4, 2) in the four cylinder engine.

Figure 5A:
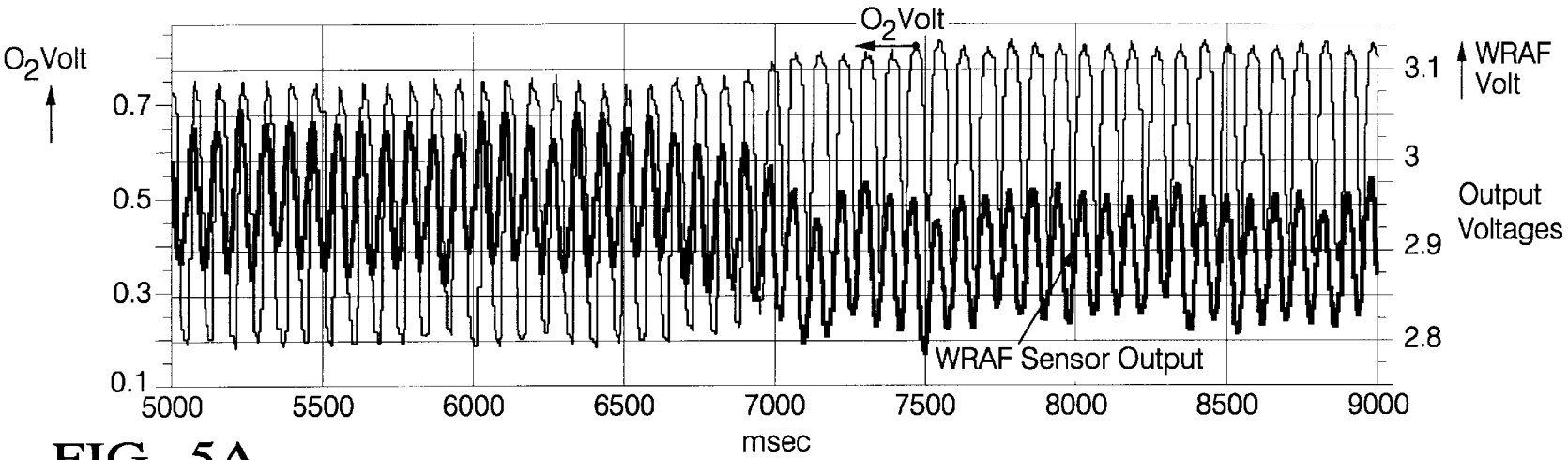
FIG. 5A is a graph of the high-frequency responses in volts, over a few seconds of engine operation, of a production zirconia oxygen sensor and of a commercial wide-range A/F ratio (WRAF) sensor both located upstream of an empty catalytic converter can in the exhaust of a four-cylinder engine.

In this test, the Vs set-point of the controller was suddenly increased from 424 mV (i.e., stoichiometric A/F=14.74) to 606 mV (corresponding to A/F=14.50). FIG. 5*a* shows the transient $O_2$ sensor response and the actual WRAF voltage measured at the same point in the exhaust manifold in response to the set-point change at about 6600 ms. The stoichiometric A/F corresponds to 3.0 V on the WRAF sensor with lower (higher) voltage values corresponding to richer (leaner) exhaust mixtures. Correlated changes in the level of $O_2$ and WRAF sensors are evident in FIG. 5*a*.

Figure 5B:
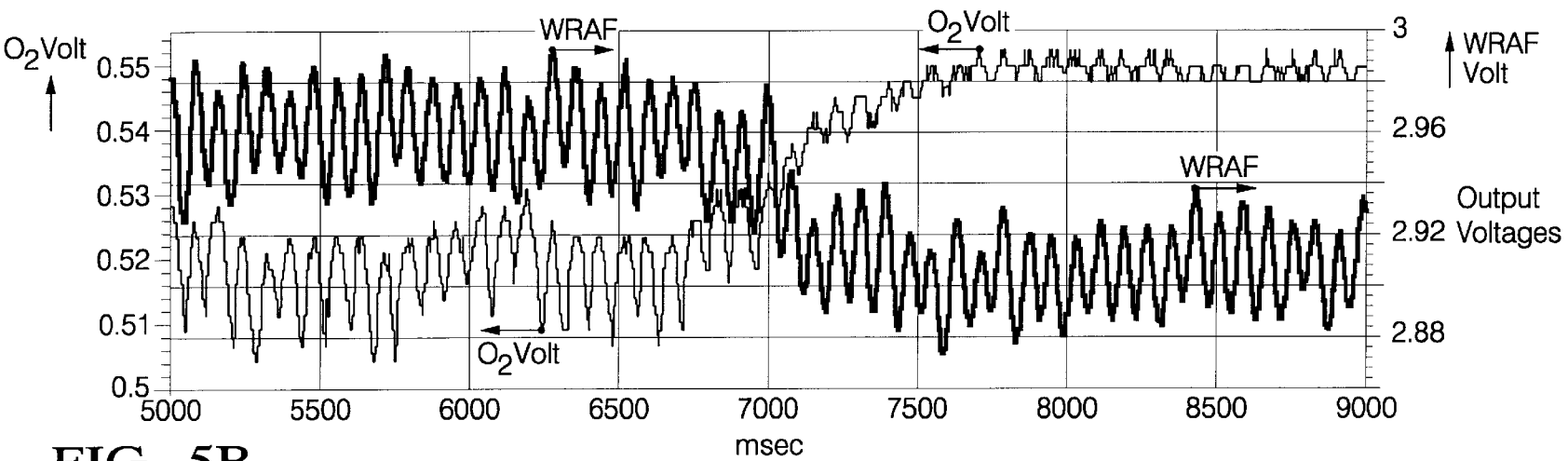
FIG. 5B is a graph like FIG. 5A of high frequency responses in volts of an automotive zirconia sensor and a WRAF sensor both located downstream of the converter can in the same exhaust system as in FIG. 5A. The converter can was empty to assure sufficient mixing of the exhaust gas and averaging of the respective voltage signals for concept verification.

FIG. 5*b* shows the response of the second set of sensors after the converter can has mixed the exhaust stream. These direct signals represent averages of the responses of the corresponding sensors in the first set (FIG. 5*a*). It is clearly seen that the average of the $O_2$ sensor voltage follows the average signal of the WRAF sensor when the commanded fuel strategy changed in a fuel rich direction. The $O_2$ sensor now acts like the linear WRAF sensor.

To test the concept on the lean side, the set-point is suddenly changed to 202 mV (corresponding to A/F=15.03). The average $O_2$ and WRAF sensors followed the desired level set by the controller. The parallel variations of $O_2$ and WRAF sensors confirmed that the subject linear $O_2$ sensor is also effective for lean A/F control.

To verify the performance of the linear $O_2$ sensor over the whole linear range, the initial set-point at 424 mV (i.e., A/F=14.74) was suddenly increased to 606 mV (i.e., A/F=14.50) and subsequently decreased to 202 mV (i.e., A/F=15.03). The fuel control system achieved its targets with good transient response. The parallel behavior of the $O_2$ and WRAF sensors indicated excellent performance and adequacy of the $O_2$ sensor operation over the linear range for direct A/F control.

The practice of the invention was further evaluated in a Buick LeSabre vehicle (with 3800 V6 engine). A WRAF sensor was installed in the exhaust manifold for A/F monitoring. Fueling was controlled with 5% fuel injector biases between banks (i.e., all cylinders had similar magnitudes of bias but of opposite sign if not belonging to the same bank) and testing was continued by changing the $O_2$ sensor set-point from 0 to 1000 mV. A distinct linear range of sensor outputs was obtained when fuel injector biases are introduced and A/F was controlled for extended operating periods at stoichiometric A/F, and at both rich and lean A/F set points.

The invention has been described in terms of a few specific embodiments. However, it is apparent that other forms of the invention could readily be adapted by one skilled in the art. Accordingly, the scope of the invention is limited only by the following claims.

What is claimed is:

1. A method of controlling fuel injection in the operation of a vehicle comprising a multi-cylinder internal combustion engine, at least one fuel injector for supplying fuel to said cylinders in a predetermined sequence over repeated fueling sequence cycles during operation of said engine, an exhaust oxygen sensor of the solid electrolyte type and a computer-based control means for receiving signals from said oxygen sensor and using said signals in determining the amount of fuel to be supplied to said cylinders, said method to be conducted by said control means and comprising repeatedly determining amounts of fuel to be delivered to said cylinders during succeeding periods of fuel injection events based on A/F control goals determined by said means and delivering fuel injection imbalances with respect to at least some of said amounts of fuel by imposing specific fuel injector biases to some or all cylinders during such periods of injection events, whereby, on average, a linear response of A/F related signals is obtained from said oxygen sensor in A/F regions of control by said means and said means controls said amounts of fuel delivered in accordance with said linear response.

2. A method as recited in claim 1 comprising delivering imbalances with respect to said amounts of fuel to some or all cylinders during each cylinder fueling sequence while adjusting said imbalances during said sequence to average an A/F goal within a range of plus or minus 1.0 A/F of the stoichiometric A/F.

3. A method as recited in claim 1 comprising delivering imbalances with respect to said amounts of fuel to some or all cylinders during such periods of injection events, said imbalances being of alternating equal and opposite magnitudes with respect to said amounts of fuel.

4. A method as recited in claim 2 comprising delivering imbalances with respect to said amounts of fuel to some or all cylinders during each cylinder fueling sequence, said imbalances being of alternating equal and opposite magnitudes with respect to said amounts of fuel.

5. A method as recited in claim 1 where said engine is a four-cylinder engine and comprising delivering said imbalances to the four cylinders in accordance with one of the following sequences:

(i) 0, $+b_1$, 0, $-b_1$, (ii) $-b_2$, $+b_2$, $-b_2$, $+b_2$, or (iii) an additive combination of (i) and (ii).

6. A method as recited in claim 2 where said engine is a four-cylinder engine and comprising delivering said imbalances to the four cylinders in accordance with one of the following sequences:

(i) 0, $+b_1$, 0, $-b_1$, (ii) $-b_2$, $+b_2$, $-b_2$, $+b_2$, or (iii) an additive combination of (i) and (ii).

7. A method for obtaining linear responses from an exhaust oxygen sensor in the operation of a vehicle comprising a multi-cylinder internal combustion engine, at least one fuel injector for supplying fuel to said cylinders in a predetermined sequence over repeated fueling sequence cycles during operation of said engine, an exhaust oxygen sensor of the solid electrolyte type and computer-based control means for receiving signals from said oxygen sensor and using said signals in determining the amount of fuel to be supplied to said cylinders, said method to be conducted by said control means and comprising repeatedly determining amounts of fuel to be delivered to said cylinders during succeeding periods of fueling injection events based on A/F control goals determined by said means and delivering fuel injection imbalances with respect to at least some of said amounts of fuel by imposing specific fuel injector biases to at least some cylinders during such periods of injection events, whereby, on average, a linear response of A/F related signals is obtained from said oxygen sensor in A/F regions of control by said means.

8. A method as recited in claim 7 comprising delivering imbalances with respect to said amounts of fuel to at least some cylinders during each cylinder fueling sequence while adjusting said imbalances during said sequence to average an A/F goal within a range of plus or minus 1.0 A/F of the stoichiometric A/F.

9. A method as recited in claim 7 comprising delivering imbalances with respect to said amounts of fuel to at least some cylinders during such periods of injection events, said imbalances being of alternating equal and opposite magnitudes with respect to said amounts of fuel.

10. A method as recited in claim 8 comprising delivering imbalances with respect to said amounts of fuel to at least some cylinders during each cylinder fueling sequence, said imbalances being of alternating equal and opposite magnitudes with respect to said amounts of fuel.

11. A method as recited in claim 7 where said engine is a four cylinder engine and comprising delivering said imbalances to the four cylinders in accordance with one of the following sequences:

(i) 0, $+b_1$, 0, $-b_1$, (ii) $-b_2$, $+b_2$, $-b_2$, $+b_2$, or (iii) an additive combination of (i) and (ii).

12. A method as recited in claim 8 where said engine is a four cylinder engine and comprising delivering said imbalances to the four cylinders in accordance with one of the following sequences:

(i) 0, $+b_1$, 0, $-b_1$, (ii) $-b_2$, $+b_2$, $-b_2$, $+b_2$, or (iii) an additive combination of (i) and (ii).

* * * * *